US011573021B2

(12) United States Patent
Smith et al.

(10) Patent No.: US 11,573,021 B2
(45) Date of Patent: Feb. 7, 2023

(54) MULTI-COMPONENT WHOLE HOUSE FAN SYSTEM

(71) Applicant: Airscape, Inc., Medford, OR (US)

(72) Inventors: Neil B. Smith, Ashland, OR (US); Richard Jacobi, Grants Pass, OR (US)

(73) Assignee: Airscape, Inc., Medford, OR (US)

( * ) Notice: Subject to any disclaimer, the term of this patent is extended or adjusted under 35 U.S.C. 154(b) by 360 days.

(21) Appl. No.: 16/946,603

(22) Filed: Jun. 29, 2020

(65) Prior Publication Data

US 2020/0408428 A1 Dec. 31, 2020

Related U.S. Application Data

(60) Provisional application No. 62/868,170, filed on Jun. 28, 2019.

(51) Int. Cl.

| | |
|---|---|
| ***F24F 11/34*** | (2018.01) |
| ***F24F 11/35*** | (2018.01) |
| ***F24F 13/14*** | (2006.01) |
| *F24F 110/10* | (2018.01) |
| *F24F 110/20* | (2018.01) |

(Continued)

(52) U.S. Cl.

CPC ..... *F24F 11/35* (2018.01); *F24F 11/34* (2018.01); *F24F 13/1406* (2013.01); *F24F 13/1426* (2013.01); *F24F 2013/1433* (2013.01); *F24F 2110/10* (2018.01); *F24F 2110/20* (2018.01); *F24F 2110/30* (2018.01); *F24F 2110/40* (2018.01)

(58) Field of Classification Search

CPC ..... F24F 2011/0006; F24F 2011/10; F24F 2011/20; F24F 2011/30; F24F 2011/40; F24F 2011/0001; F24F 2007/0025; F24F 2013/1433; F24F 13/1406; F24F 11/34; F24F 11/35; F24F 7/007

See application file for complete search history.

(56) References Cited

U.S. PATENT DOCUMENTS 2,191,774 A * 2/1940 Reed ..... F24F 13/1426 137/527

2,278,581 A * 4/1942 Dexter ..... F24F 7/007 454/348

(Continued)

*Primary Examiner* — Steven S Anderson, II

(74) *Attorney, Agent, or Firm* — Hall Estill Law Firm

(57) ABSTRACT

Apparatus and method for ventilating a building structure, such as a residence. In some embodiments, a ventilation system includes a damper assembly which extends through an interior substrate (e.g., an interior wall) of the structure and an exhaust assembly which extends through an exterior substrate (e.g., an exterior wall of the structure and which is in communication with the damper assembly via a control circuit. The interior wall separates a conditioned space and an unconditioned space. The exhaust assembly is initially activated to vent exhaust air from the unconditioned space while a door of the damper assembly remains closed. The door is subsequently opened responsive to a measured environmental parameter, such as a differential pressure between the conditioned and unconditioned spaces, to generate a combined airflow that passes from the conditioned space to the unconditioned space and then to the exterior of the structure.

20 Claims, 6 Drawing Sheets

(51) Int. Cl.
*F24F 110/30* (2018.01)
*F24F 110/40* (2018.01)

(56) References Cited

U.S. PATENT DOCUMENTS

| | | | | | |
|---|---|---|---|---|---|
| 2,299,833 | A * | 10/1942 | Mader | F24F 13/15 | 454/352 |
| 3,839,839 | A | 10/1974 | Tillisch et al. | | |
| 4,152,878 | A | 5/1979 | Balinski | | |
| 4,385,550 | A | 5/1983 | Steiner et al. | | |
| 4,501,389 | A * | 2/1985 | Kolt | F24F 13/1426 | 236/49.5 |
| 4,811,538 | A | 3/1989 | Lehnert et al. | | |
| 5,718,785 | A | 2/1998 | Randall | | |
| 5,740,644 | A | 4/1998 | Menchetti | | |
| 5,945,209 | A | 8/1999 | Richards et al. | | |
| 7,410,920 | B2 | 8/2008 | Davis | | |
| 7,775,006 | B2 | 8/2010 | Glannos | | |
| 7,878,301 | B2 | 2/2011 | Gross et al. | | |
| 8,590,231 | B2 | 11/2013 | Pilz | | |
| 8,726,586 | B1 * | 5/2014 | Stevens | F24F 7/00 | 52/302.1 |
| 9,045,899 | B2 | 6/2015 | Pilz et al. | | |
| 9,188,508 | B1 * | 11/2015 | Meyer | G01M 3/2815 | |
| 9,458,628 | B2 | 10/2016 | Pilz et al. | | |
| 10,184,246 | B2 | 1/2019 | Pilz et al. | | |
| 11,149,432 | B2 | 10/2021 | Gatland et al. | | |
| 2009/0084507 | A1 | 4/2009 | Tescher | | |
| 2010/0332034 | A1 * | 12/2010 | Bergeson | E06B 7/32 | 700/275 |
| 2014/0065939 | A1 * | 3/2014 | Dietz | F24F 11/0001 | 454/234 |

* cited by examiner

MULTI-COMPONENT WHOLE HOUSE FAN SYSTEM

RELATED APPLICATIONS

The present application makes a claim of domestic priority under 35 U.S.C. 119(e) to U.S. Provisional Patent Application No. 62/868,170 filed Jun. 28, 2019, the contents of which are hereby incorporated by reference.

BACKGROUND

Ventilation systems are used to supply environmentally controlled air to the interior of a structure, such as a residential habitation (e.g., a house). A particularly useful type of ventilation system is sometimes referred to as a Whole House Fan ("WHF") system.

A typical WHF system operates to draw cooler outside air through a conditioned space of the structure, such as an interior residential area, and into an unconditioned space, such as an attic or garage. The air is then vented from the unconditioned space to the exterior environment. This allows the structure to be convectively cooled at times when the outside temperature is lower than the inside temperature, such as during overnight and early morning hours. WHF systems can often maintain a desired cool interior temperature with little or no need to operate traditional HVAC equipment, producing significant energy cost savings for a user.

While WHF systems have been found operable in reducing cooling costs and enhancing indoor comfort, there remains a continual need for improved efficiencies with such systems. It is to these and other advancements that the present disclosure is directed.

SUMMARY

Various embodiments of the present disclosure are generally directed to an apparatus and method for ventilating the interior of a building structure, such as but not limited to a residence.

As explained below, some embodiments include a ventilation system with a damper assembly and an exhaust assembly coupled via a control circuit. The damper assembly extends through an interior substrate (e.g., an interior wall) of the structure and the exhaust assembly extends through an exterior substrate (e.g., an exterior wall of the structure. The interior wall separates a conditioned space and an unconditioned space within the structure. The exhaust assembly is initially activated to vent exhaust air from the unconditioned space while a door of the damper assembly remains closed. The door is subsequently opened responsive to a measured environmental parameter, such as a differential pressure between the conditioned and unconditioned spaces, to generate a combined airflow that passes from the conditioned space to the unconditioned space and then to the exterior of the structure.

Further embodiments provide a method with general steps including activating an exhaust assembly that extends through an exterior substrate of a building structure to actively direct, via an impeller, an initial flow of exhaust air from an unconditioned space of the building structure to an exterior environment. The unconditioned space is separated from a conditioned space of the building structure via an interior substrate through which a damper assembly extends having a moveable door in a closed position. An environmental parameter associated with the unconditioned space is monitored using an environmental sensor. A control signal from a control circuit coupled to the environmental sensor is issued to transition the moveable door of the damper assembly from the closed position to an open position responsive to the environmental parameter reaching a predetermined threshold. This generates a combined flow of exhaust air from the conditioned space, through the damper assembly, through the unconditioned space, and through the exhaust assembly to the exterior of the building structure.

Other features, details and advantages of various embodiments can be understood from a review of the following detailed description in conjunction with the accompanying drawings.

DETAILED DESCRIPTION

Figure 1:
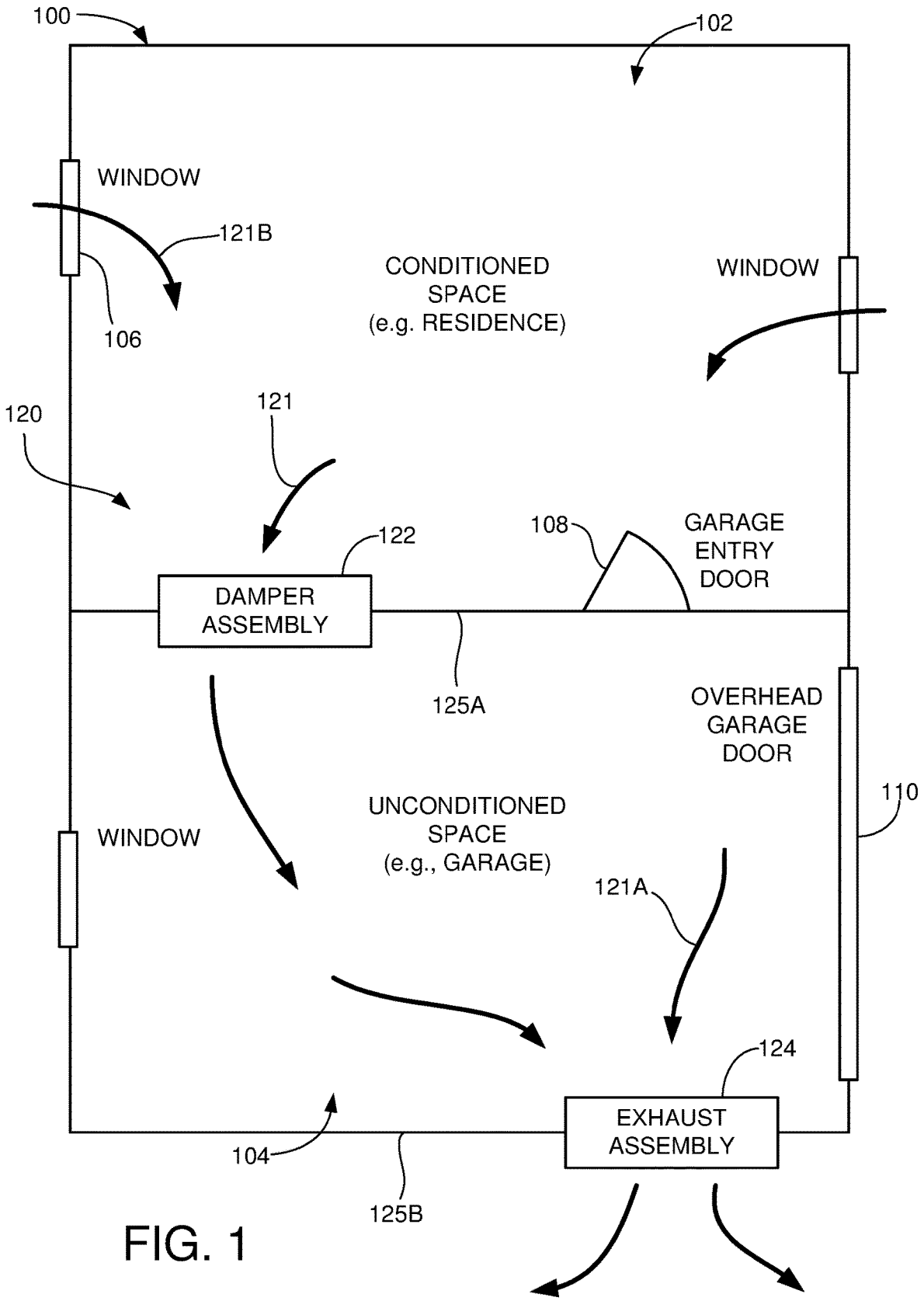
FIG. 1 is a schematic depiction of a ventilation system constructed and operated in accordance with various embodiments of the present disclosure.

Various embodiments are generally directed to improvements to ventilation systems for various types of structures. As explained below, the system may be characterized as a multi-component whole house fan (WHF) system. The system as variously embodied includes two main components, or parts: a damper assembly and an exhaust assembly. These two components are mounted in separate locations and may be placed in electronic communication with each other via an intervening control circuit.

The damper assembly is configured to mount in a boundary substrate (e.g., a wall or a ceiling) that separates a conditioned space and an unconditioned space within a building structure. The conditioned space could be, for example, the interior of a residential home, the interior of an inhabited work space such as an office building, warehouse, etc. For reference, a "conditioned" space as used herein does not necessarily require the space to be serviced by an actual HVAC system, but it can be adequately described as a space that is conditioned for the long term presence of a human. Contrawise, an "unconditioned" space is generally not. Hence, the terms "conditioned" and "unconditioned" spaces can also sometimes be referred to as normally "inhabited" and "uninhabited" spaces, respectively, and provide different respective isolation levels with respect to an exterior environment to the building structure.

The damper assembly has one or more normally closed doors that are configured to thermally isolate the conditioned and unconditioned spaces. The door(s) can be activated in any number of ways including laterally out, swinging out, retracting or extending vertically or horizontally, and so on. The door(s) form both a fire seal and a fluidic seal. The fire seal retards fire passing from the unconditioned to the conditioned space in accordance with applicable building codes. The fluidic seal retards the passage of vapors or other noxious fumes that may normally be present in the unconditioned space (e.g., gasoline fumes emitted from within an attached garage, etc.) or otherwise substantially prevents airflow between the respective spaces.

A biasing mechanism is incorporated into the damper assembly so that under normal conditions, including a loss of power, the door(s) will automatically transition to the closed, sealed position. A spring or other biasing member may be used. A latch can be used to mechanically retain the door(s) to effect an adequate fluidic seal in the closed position. The fluidic seal thus does not necessarily need to be a "gas tight" seal as long as the seal effectively restricts fluidic flow below some upper acceptable limit.

An actuator mechanism may also incorporated into the damper assembly. The actuator mechanism operates to transition the door(s) between the closed and open positions. Any number of actuators can be used such as solenoids or other mechanical or electro-mechanical devices. Aspects of the damper may be automated, semi-automated, electronic, fusible, mechanical, and/or manually activated as required.

While not limiting, it is contemplated in at least some embodiments that the damper system will be arranged to ventilate air from an interior residential area into the unconditioned space of an attached garage. One suitable location for the damper assembly is over an access door that allows passage from the residential space to the garage, although other installation locations may be used.

The exhaust assembly is mounted at a second boundary that extends between the unconditioned space to the exterior environment outside the structure. In an attic or garage application, this might be through a wall or a roof.

The exhaust assembly has a fan (impeller) activated by a motor to vent exhaust air from the unconditioned space to the exterior environment. Because the exhaust assembly is not directly mechanically coupled to the damper assembly, there is no need for intervening ductwork between the exhaust assembly and the damper assembly as in many conventional WHF systems. Moreover, larger fan sizes can be used to direct the air to the exterior environment. Because the exhaust assembly is coupled to the outside environment, additional elements may be required as well such as normally closed doors, security bars/screens, ports, rain covers, etc.

The exhaust assembly may include a main controller circuit that communicates with a corresponding controller circuit of the damper assembly so that, when the fan is activated, the damper door(s) is/are opened. This allows the fan assembly to direct air through the conditioned space, through the damper assembly, through the unconditioned space, through the fan assembly, and to the exterior environment. A relatively large flow (such as 3,000 to 5,000 cfm or more) may be needed to establish the desired airflow through the structure.

In some embodiments, a differential pressure sensor is provided in the damper system. The differential pressure sensor monitors the relative pressure differential between the conditioned and unconditioned spaces. In this way, the exhaust assembly can be activated to push air from the unconditioned space into the exterior environment. The resulting drop in pressure within the unconditioned space will be sensed by the pressure sensor, resulting in the automatic opening of the door(s) of the damper assembly to draw air from the unconditioned space.

A sudden increase in pressure within the unconditioned space, such as due to an opening of a garage bay door, can operate to temporarily close the damper. In this way, undesired airflow from the garage (or other unconditioned space) can be kept from flowing back into the conditioned space. The exhaust assembly can continue to run and the damper assembly reopen once the pressure differential is reestablished.

While not necessarily required, it is contemplated that both the exhaust assembly and the damper assembly will operate on a low voltage DC system (such as, e.g., 24 VDC). A hard wired or wireless communication interlink can be established between the respective units. A third, main control unit can further be located within the conditioned space to allow user commands and data to be transferred to and from the exhaust assembly and/or the damper assembly.

The system as variously described herein provide a number of advantages, including ease of installation, noise abatement, and backflow control. These and other features and advantages can be understood beginning with a review of FIG. 1 which shows a residential structure 100 having a conditioned space (e.g., an interior residential area) and an attached unconditioned space (e.g., an attached garage). The residential structure 100, more generally referred to as a building structure, has a number of ingress and egress features including various windows 106, a normally closed garage entry door 108 and an overhead garage door 110.

A ventilation system for the structure 100 is generally denoted at 120. The ventilation system 120 is configured to establish an airflow (arrows 121) through the structure 100. To this end, the system 120 includes a damper assembly 122 and an exhaust assembly 124. The damper assembly 122 is installed through a first wall 125A that extends as an interior wall between the residence 102 and the garage 104. The exhaust assembly 124 extends through a second wall 125B that is an exterior wall of the garage.

As explained is greater detail below, the exhaust assembly 124 includes an impeller configured to draw the airflow 121 through the structure 100. The damper assembly 122 includes a door that is moveable between a closed position and an open position. The damper assembly 122 and the exhaust assembly 124 are operably coupled using suitable control circuitry (not separately shown in FIG. 1).

In at least some embodiments, the ventilation system 120 is operative to initiate a first flow of exhaust air (e.g., airflow) using the exhaust assembly 124 while the damper assembly 122 remains in the closed position. This first airflow, denoted by arrow 121A, is substantially drawn only from the unconditioned space 104 and vented as exhaust air to the exterior of the structure. Generally, this operation will tend to lower the interior pressure within the unconditioned space and to remove heat from the unconditioned space.

Once a sensed environmental parameter reaches a desired level, such as a differential pressure between the conditioned and unconditioned spaces, the damper assembly is opened by the control circuitry. This establishes a combined flow of exhaust air (e.g., combined airflow) that includes additional air from the conditioned space, denoted by arrow 121B, that is drawn by the exhaust assembly. In this way, the combined airflow 121 is established into and through the residence 102, through the damper assembly 122, through the garage 104, through the exhaust assembly 124, and out to the exterior environment. This combined airflow serves to cool or otherwise improve the interior state of the conditioned space and the unconditioned space.

Figure 2:
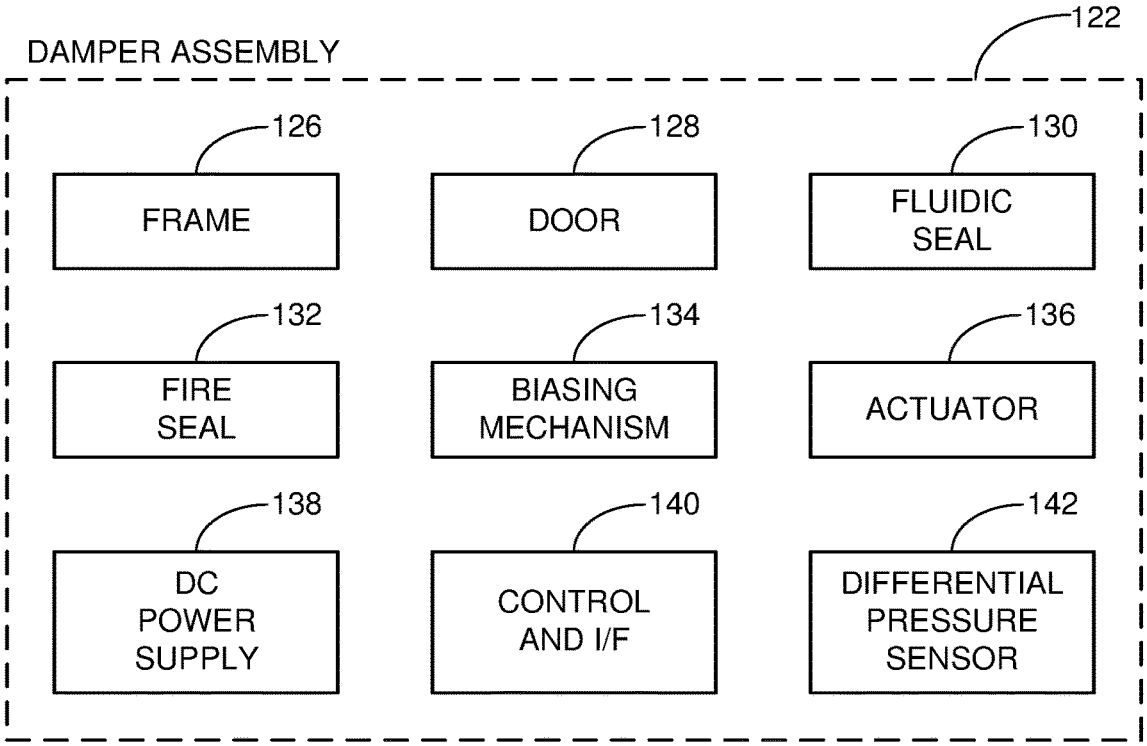
FIG. 2 is a functional block representation of a damper assembly of the ventilation system of FIG. 1 in some embodiments.

FIG. 2 shows a functional block diagram of the damper assembly 122 in accordance with some embodiments. Other arrangements can be used so that FIG. 2 is merely exemplary and is not limiting. The damper assembly 122 is shown to include a mechanical frame 126, a door 128, a fluidic seal 130, a fire seal 132, a biasing mechanism 134 and an actuator 136.

As described above, the door 128 may be formed of multiple doors (shutters, plates, etc.) normally biased in a closed position by the biasing mechanism 134 and transitioned to an open position by the actuator 136. The fluidic seal 130 may be a metal-to-metal seal or may use an elastomeric or other sealing gasket as desired. The fire seal 132 may comprise gypsum board or other suitable fire resistant materials that form a portion of the construction of the door. In this way, the door provides a fire and fluidic barrier when in the closed position. A suitable fusible mechanical link or other control mechanism can be incorporated to cause the door 128 to fail shut responsive to an anomalous event (e.g., detected fire condition, power loss, etc.).

The damper assembly 122 is further shown in FIG. 2 to include a DC power supply 138, a control and interface (I/F) circuit 140 and a differential pressure sensor 142. The DC power supply may draw power from a normal residential AC source (e.g., 60 Hz 120 VAC, etc.) and include a transformer and other circuit elements to supply the electrical components of the damper assembly 122 with DC voltage(s) at appropriate levels (e.g., 3 VDC, 5 VDC, 12 VDC, 24 VDC, etc.).

The control and I/F circuit 140 may include one or more programmable processors with associated programming (e.g., firmware) in suitable memory to carry out various communication and control functions for the damper. The circuit 140 may additionally or alternatively be formed of hardware circuits (e.g., gate logic, field programmable arrays, etc.) to perform these functions.

The differential pressure sensor 142 is configured to sense respective interior atmospheric pressures at the residence 102 and the garage 104 (e.g., on opposing sides of wall 125A, FIG. 1). The sensor 142 can report these pressures to the circuit 140 as well as to other elements in the system 100.

Figure 3:
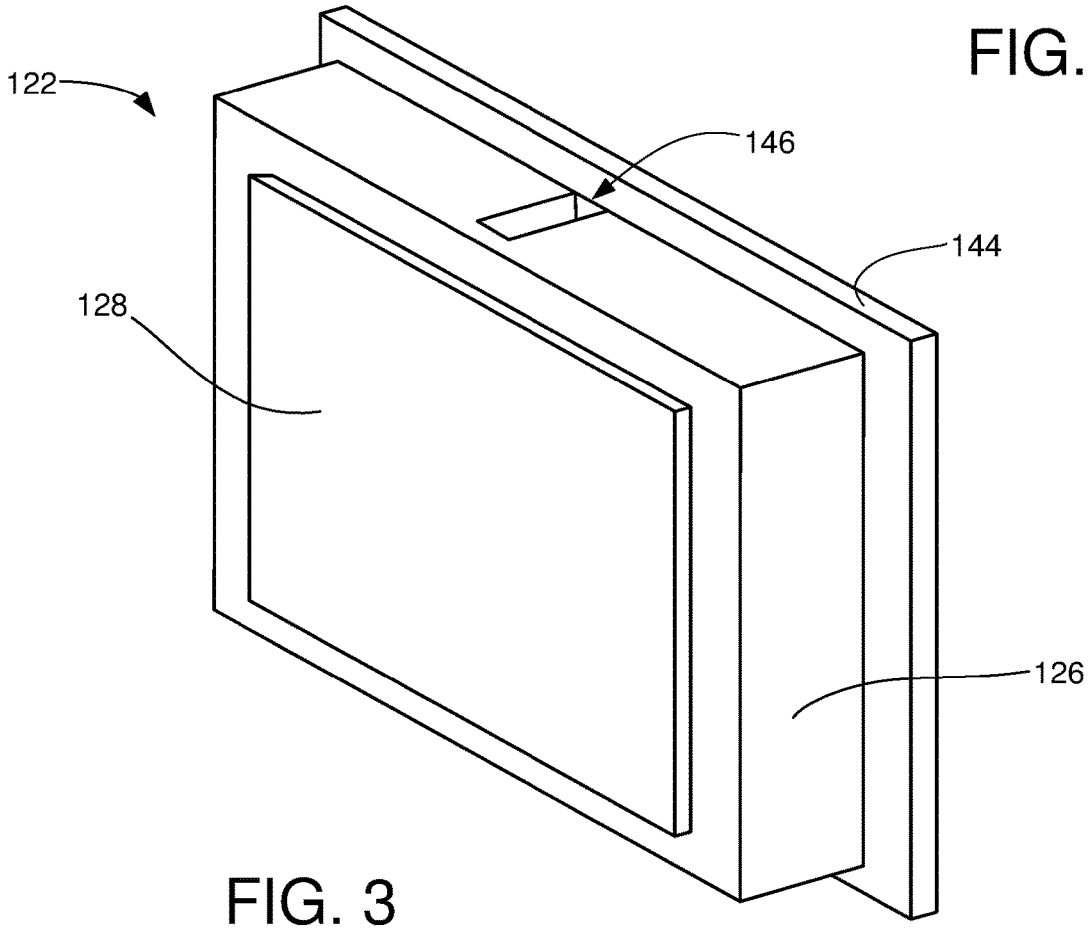
FIG. 3 is a simplified isometric depiction of the damper assembly of FIG. 2 in some embodiments.

FIG. 3 is a simplified isometric depiction of the damper assembly 122 in some embodiments. FIGS. 4A through 4D show additional views. Other configurations can be used as desired. Generally, the frame 126 is substantially rectilinearly shaped and is sized to extend through the boundary wall 125A (FIG. 1). A covering screen 144 extends across the front (interior residence side) of the damper assembly, and the door 128 extends across the back (garage side) of the damper assembly, as further depicted in FIGS. 4A and 4B. As desired, the orientation of the damper assembly can be reversed so that the screen 144 faces the garage and the door 126 faces the residence.

Figure 4A:
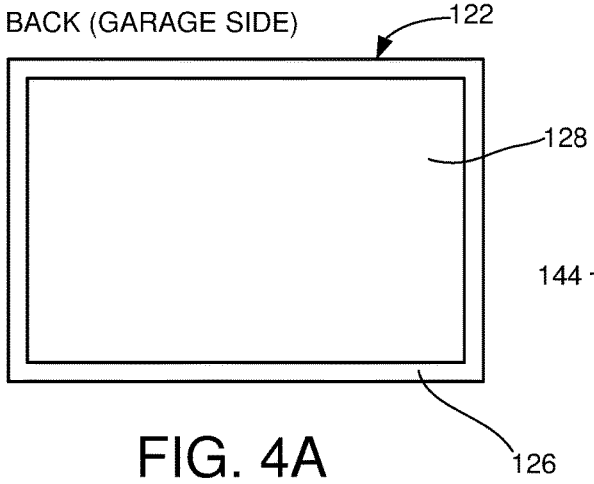
FIGS. 4A through 4D provide respective back, front, side and top views of the damper assembly of FIG. 3.
Figure 4B:
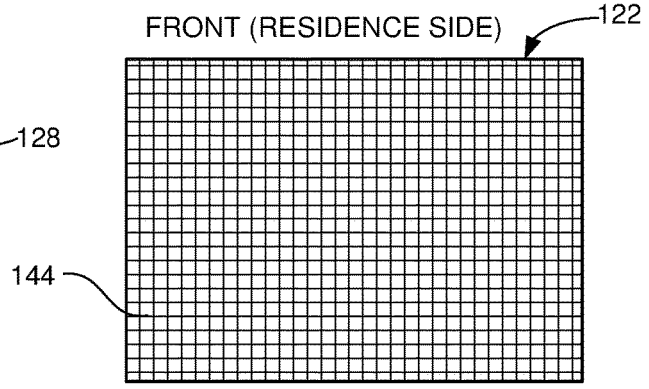
Figure 4C:
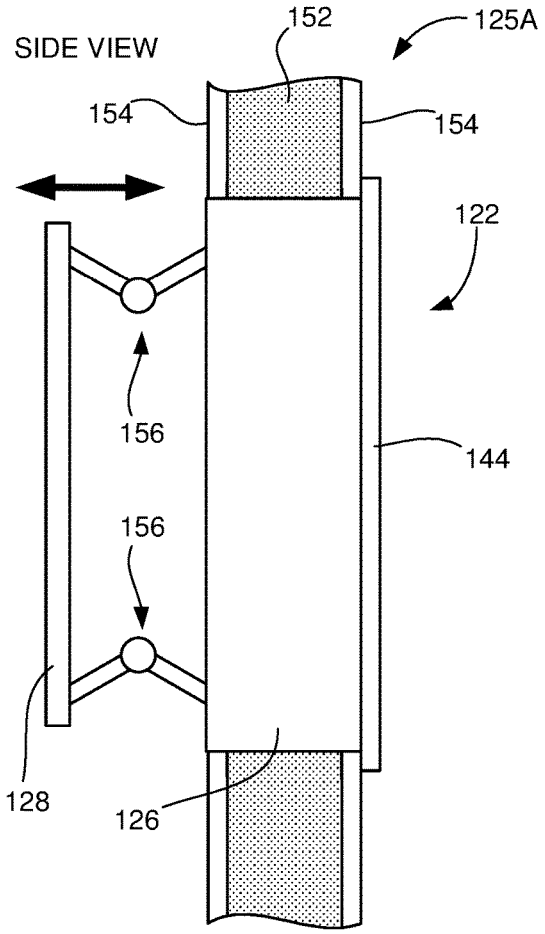
Figure 4D:
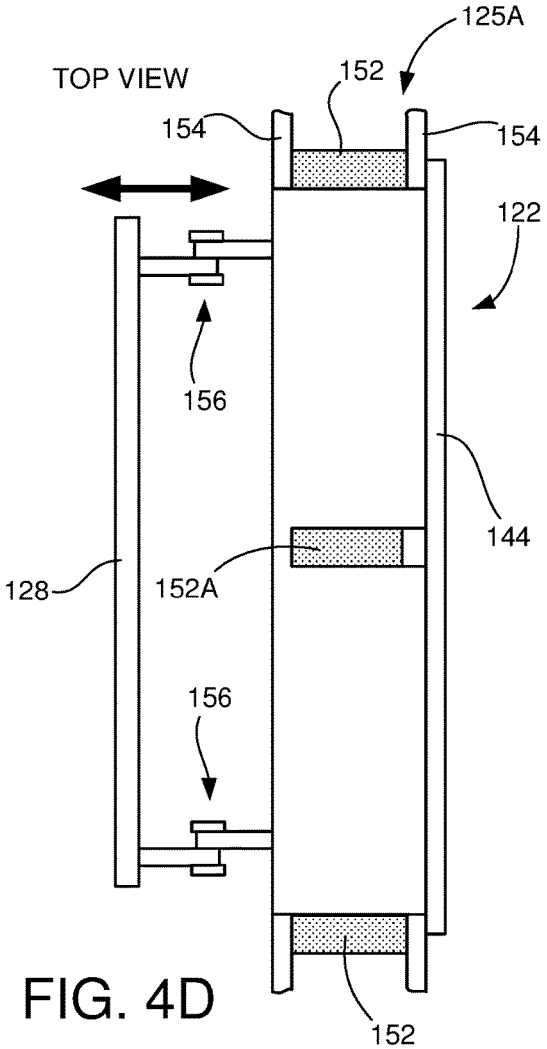

As best shown in FIGS. 4C and 4D, the boundary wall 125 can be formed using spaced apart joists 152 and covered by facia such as sheetrock layers 154. A central slot 146 (see FIG. 3) can be provided in the frame 126 of the damper assembly 122 to accommodate a central joist 152A. In some cases, the joists 152 will be arranged at a standard spacing of nominally 16 inches center-to-center, allowing the unit to have an overall width just short of nominally 32 inches (see FIG. 4D). Other arrangements can be used, however, including a narrower damper configuration that can fit between a single pair of joists (on a 16 inch spacing or some other spacing), using a specially framed in box within the wall to accommodate the frame 126, etc.

Suitable openings can be cut in the existing sheetrock layers 154 to accommodate the damper frame. The door 128 is arranged as a single flat plate with articulating arms 156 that allow the door 128 to be advanced and retracted by the actuator 136 as required (best viewed in FIGS. 4C and 4D).

Figure 5:
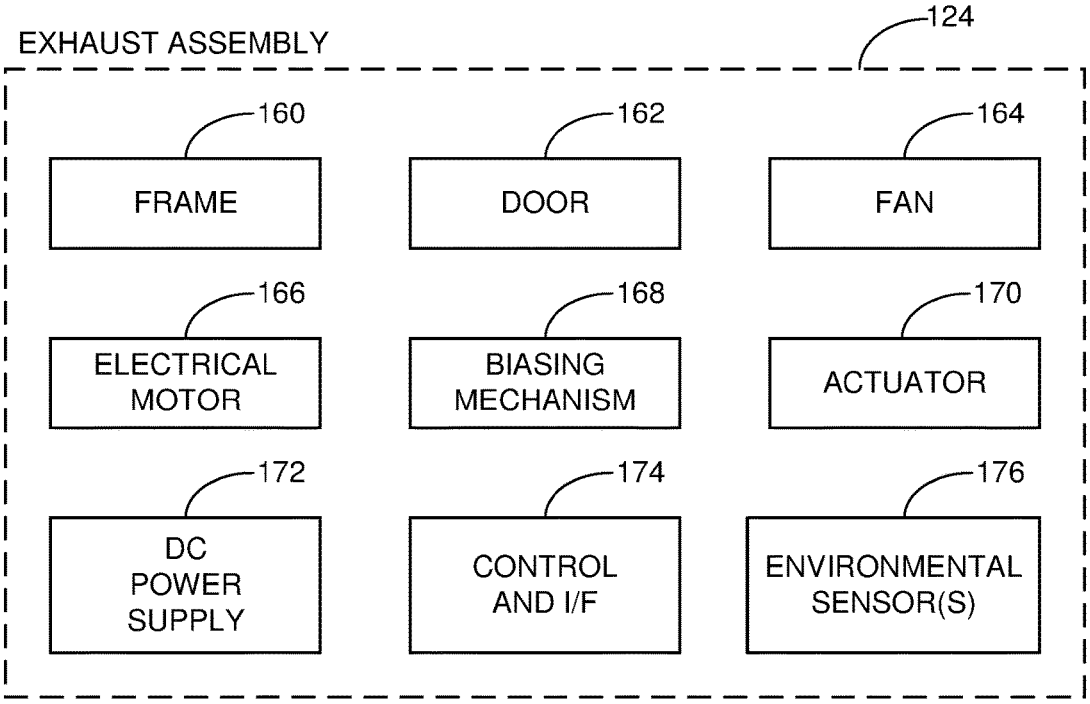
FIG. 5 is a functional block representation of an exhaust assembly of the ventilation system of FIG. 1 in some embodiments.
Figure 6A:
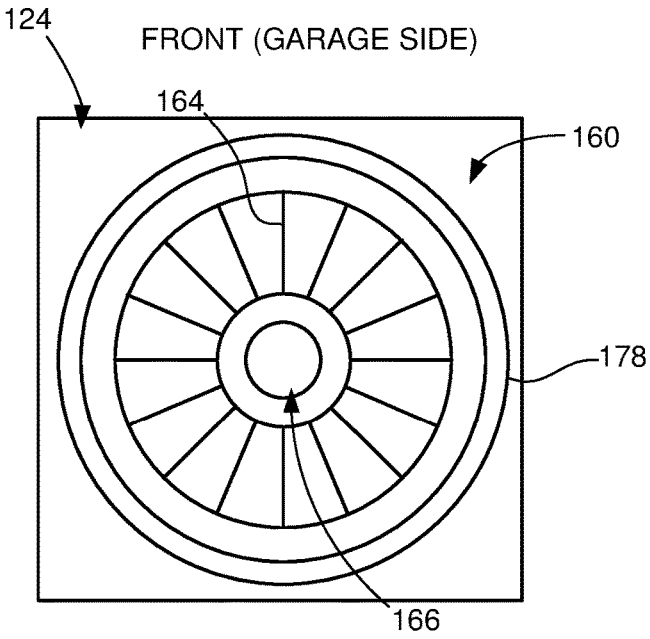
FIGS. 6A and 6B are respective front and side views of the exhaust assembly of FIG. 5.
Figure 6B:
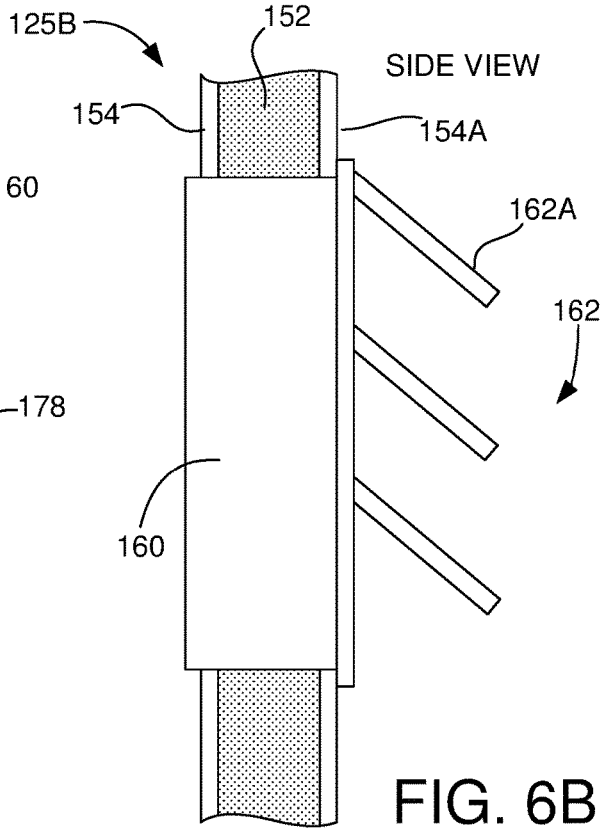

FIG. 5 is a functional block representation of the exhaust assembly 124 in some embodiments. FIGS. 6A and 6B show respective front and side views of the exhaust assembly. As before, the depicted arrangement in FIGS. 5, 6A-6B is merely illustrative and is not limiting.

FIG. 5 shows the exhaust assembly 124 to include a frame 160, a door 162, a fan (impeller) 164, an electrical motor 166, a biasing mechanism 168 and an actuator 170. For reference, the door 162 in the exhaust assembly 124 can be characterized as an exterior door, while the door 128 in the damper assembly 122 can be characterized as an interior door.

In this example, the door 162 is arranged as three slatted shutters 162A (see FIG. 6B). As before, the door 162 is normally closed when non-operational, and may be biased in this position by the biasing mechanism 168 such as through the use of a spring. The actuator 170 may be a separate electro-mechanical device that opens the shutters 162A during operation, or may rely on gravity or other mechanisms such that, when the fan is activated, the door shutters 162A are automatically flipped to the open position as shown.

Continuing with FIG. 5, the exhaust assembly 124 is further shown to include a DC power supply 172, a control and I/F circuit 174 and one or more environmental sensors 176. The sensor(s) can provide measurements of any suitable number and combination of environmental parameters (e.g., temperature, current, pressure, airflow, etc.). As with the damper assembly 122, the control and I/F circuit 174 may be arranged as programmable and/or hardware circuits to carry out various control functions for the system 100.

As with the damper assembly 122, the exhaust assembly 124 can take any suitable size to extend through the exterior wall 125B which, it will be noted, may be similarly fashioned to include spaced apart joints 152 and suitable facia 154. Because the exterior wall 125B is facing the exterior environment outside the structure 100, additional layers may make up the exterior facia (denoted at 154A), such as sheathing, brick, rock, stucco, siding, etc. These details have been omitted from the drawings for clarity, but it will be understood that the exhaust assembly is sized to accommodate these and other alternatives and nominally extend through/past these outer facia elements.

A central, circular cowling 178 can be arranged to surround and duct the impeller blades of the fan 164. As noted above, it is contemplated that the exhaust assembly will be configured to move a relatively large amount of air during operation (e.g., such as on the order of 3,000 to 5,000 cfm or more). This will tend to lower the interior pressure within the garage 104, enabling the damper assembly to safely open and establish the airflow depicted in FIG. 1.

It is contemplated that the respective damper assembly 122 and exhaust assembly 124 can be placed at any suitable locations, including locations that are tens or even hundreds of feet apart, depending on the size and capabilities of the unit and the volume(s) of the conditioned and unconditioned spaces. Hence, unlike many conventional WHF systems, there is no intervening ductwork that mechanically couples the respective damper and exhaust assemblies. Rather, the unconditioned space operates as the fluidic "channel" between these respective elements.

Figure 7:
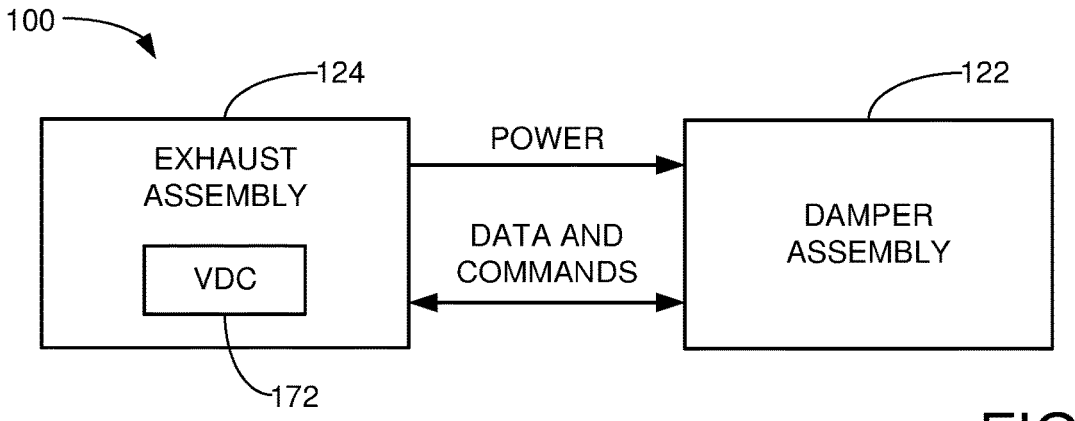
FIG. 7 shows a hardwire interconnection between the exhaust assembly and the damper assembly in some embodiments.

It is contemplated in some embodiments that electrical interconnection will be provided between the exhaust assembly 124 and the damper assembly 122. As shown in FIG. 7, a single DC voltage source 172 is provided to provide electrical power for both the exhaust assembly 124 and the damper assembly 122. Power cables as well as electrical signal cables (e.g., Ethernet cabling, etc.) can be extended and routed between the respective units. In this way, activation of the fan in the exhaust assembly can be signaled to the damper assembly, and once the required differential pressure is measured, the damper can open to allow airflow into and through the conditioned space. Any suitable parameter or combination of parameters can be used to activate the damper assembly, so differential pressure is contemplated but not necessarily required.

Figure 8:
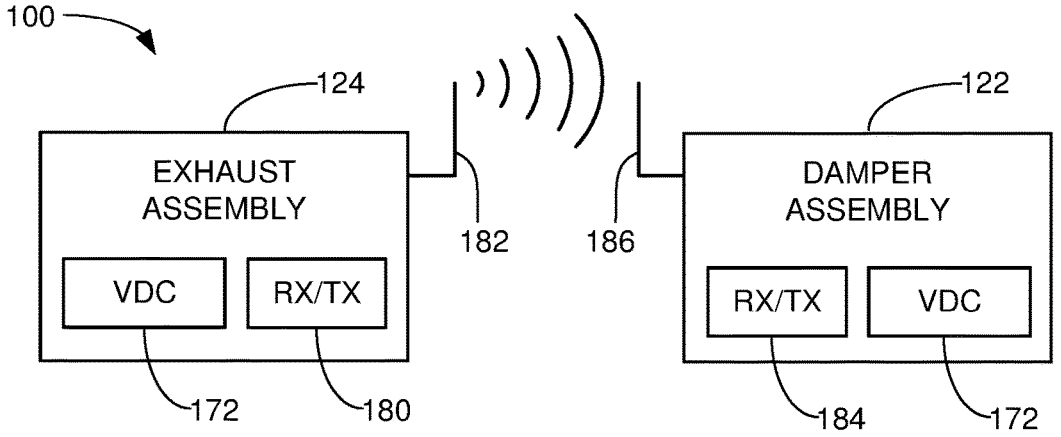
FIG. 8 shows a wireless interconnection between the exhaust assembly and the damper assembly in further embodiments.

FIG. 8 shows another alternative embodiment in which a wireless communication path is supplied to enable communications between the exhaust assembly 124 and the damper assembly 122. In this case, each unit supplies its own DC power using the associated DC voltage sources 138, 172. The exhaust assembly 124 has a receiver/transmitter (RX/TX) circuit 180 and associated antenna 182 that enables it to communicate with a corresponding RX/TX circuit 184 and antenna 186 of the damper assembly 122. Any number of commands, data and status exchanges are contemplated between the respective units 122, 124 as required using either wired or wireless interfaces. In some cases, user interaction, monitoring and activation can be carried out through a user network accessible device such as a smart phone, tablet, computer, IoT module in communication with the respective units 122, 124.

Figure 9:
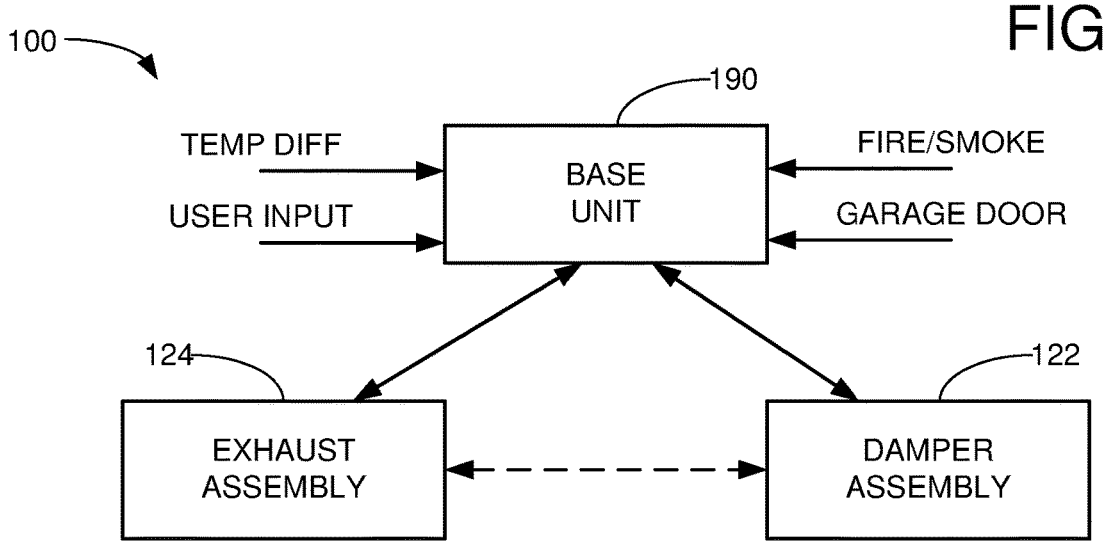
FIG. 9 shows an interconnection of the exhaust assembly and the damper assembly using a separate base controller unit.

FIG. 9 shows yet another embodiment for the system 100 in which a central base unit 190 can further be configured to communicate with either or both of the damper assembly 122 and the exhaust assembly 124. Various sensor inputs can be supplied to or obtained by the base unit 190, enabling various functions to occur such as turning on and off the fan and opening and closing the damper. Moreover, certain sensors can also be used such as a smoke or fire detector or a garage door opening sensor to automatically close the damper.

In one control sequence, the base unit 190 can be user selected to automatically or manually initiate operation of the exhaust assembly 124 based on a measured temperature differential between the exterior temperature and the internal temperature of the residence. The control circuitry (e.g., 140) in the damper assembly 122 can thereafter be used to transition the door 128 to the open position once sufficient negative relative pressure has been generated within the garage to permit a flow of air from the residence to the garage. As in the example of FIG. 8, the base unit 190 can include a network router or other interface to enable user interaction using a suitable app or other mechanism. Other sequences and arrangements will readily occur to the skilled artisan in view of the present disclosure.

Figure 10:
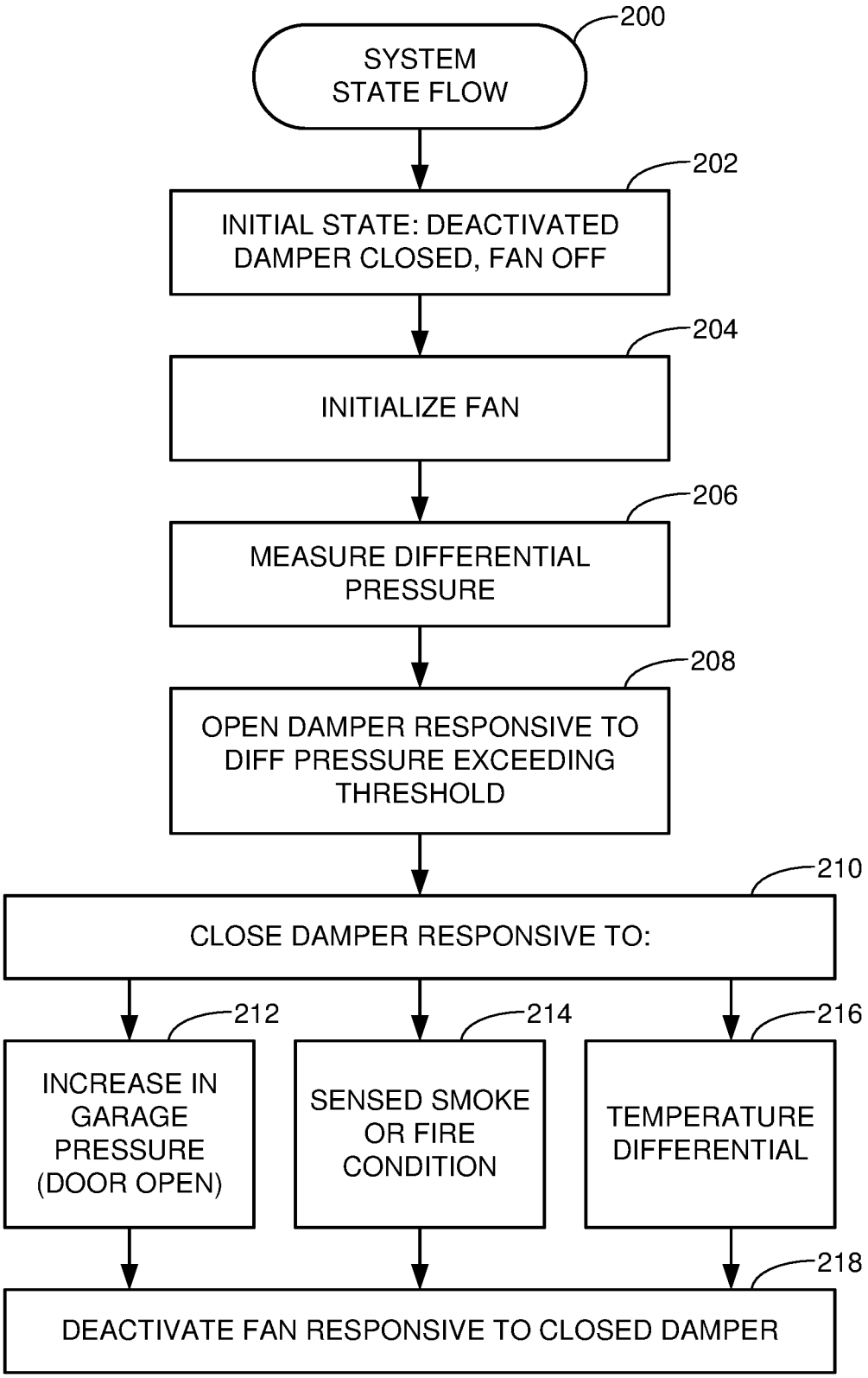
FIG. 10 is a flow chart for a system state flow diagram to illustrate different operational states of the ventilation system in accordance with various embodiments.

FIG. 10 is a flow chart for a system state flow 200 for the system 100 in accordance with the foregoing discussion. The flow 200 represents various states of the system and may be realized by hardware and/or programming by the various control circuits of the system.

Step 202 identifies an initial deactivated state for the system in which the damper doors are closed and the fan is turned off. The fan is initialized at step 204 such as by the receipt of a control signal from the base unit, the damper assembly and/or a local environmental sensor.

The differential pressure on opposing sides of the closed damper assembly is next measured at step 206. Initially it is contemplated that the interior pressure PI will be nominally the same as the exterior pressure PE. However, provided that the fan exhausts a sufficient amount of air from the garage, and other equalizing factors are not in play (e.g., the garage door is not open to any significant extent, a window in the garage is not open, etc.) then PE will drop to a point where the difference exceeds some threshold T (e.g., PI−PE>T).

The actual threshold pressure differential does not need to be a large amount, and may be a small percentage of PI (e.g., T=0.02 PI, 0.05 PI etc.). The threshold pressure may be adjustable and set by the user interfacing with the system (e.g., the base unit, the exhaust assembly, or the damper assembly).

The damper doors 128 are thereafter opened automatically once the differential pressure exceeds the selected threshold, as indicated by step 208. However, other mechanisms can be used; in other embodiments, the damper assembly opens at the same time that the fan is activated, or automatically opens after some predetermined elapsed time interval after activation of the fan (e.g., 30 seconds, one minute, etc.), and so on. Once step 208 is reached, the system is flowing as shown in FIG. 1 to draw cooler air out and through the structure to cool the residence 102.

Step 210 contemplates subsequent steps that result in the closing of the damper doors in the damper assembly 122. These can include the following.

As shown by step 212, a sudden increase in garage pressure is sensed such as by the differential pressure sensor 142. This can occur, for example, by a user opening the door 108, opening the overhead garage door to allow a vehicle to enter or exit the garage 104, etc. The closing of the damper under these conditions seal off the garage from the residence, reducing the flow of vapors or other undesired fumes/odors from seeping into the residence.

As shown by step 214, the damper can instead be closed based on a sensed smoke or fire condition, thereby effecting the fire seal between the garage and the residence.

As shown by step 216, a temperature differential may be sensed such that, for example, the outside temperature is now warmer (or at least within a predetermined differential) than the temperature of the residence. In this case, the system shuts down automatically as there is no little or no benefit to continue attempting to cool the residence using the exterior air.

These different scenarios for damper closure can result in different operations of the damper assembly. For example, some conditions may result in an immediate fast closure of the damper doors, such as in the case of fire or smoke. Other conditions may involve a delay or a slow closure of the damper assembly, such as in the case of the garage door being opened or the temperature differential being reached.

As a result, it is contemplated albeit not necessarily required that the fan of the exhaust assembly will be deactivated upon the closing of the damper. In some cases, the fan may continue to operate until some predetermined time limit has been reached; for example, if the damper remains closed for more than two (2) minutes, the fan proceeds to shut down. It is noted that if the garage door is opened and the damper is closed, the continued operation of the fan for a short time will tend to exhaust any noxious fumes that may have otherwise accumulated in the garage, so that there is a benefit to operating the fan even with the damper in the closed position.

While FIG. 10 shows various states of the system, other states may become apparent based on the present disclosure. It will be appreciated that any number of command and data flows can be established between the various components to effect these and other states.

One advantage of utilizing differential pressure as an exemplary parameter to control the sequential operation of the exhaust and damper assemblies is that, generally, the airflow will naturally tend to flow from the conditioned space to the unconditioned space with little or no backflow in the opposite direction. However, other parameters can be used instead of, or in additional to, differential pressure. In an alternative embodiment, a temperature of the unconditioned space may be monitored and required to drop by some amount, or the differential temperature between the respective spaces will be required be within some acceptable range, before the damper assembly is activated (e.g., an operation to "cool" the unconditioned space by removing excess heat may be advantageous before opening the damper door, etc.).

In still further cases, a programmable timer can be used to activate the damper based on assessment of a suitable amount of time of prior operation of the exhaust assembly to generate the appropriate internal environmental state to warrant the opening of the damper assembly.

It will now be appreciated that the multi-component WHF ventilation system as embodied herein can provide a number of benefits over the existing art, including efficiencies that can be realized during manufacturing, shipment, installation and operation. The multi-part design provides the user with great latitude in the respective locations of the constituent components. The availability of conventional 120 VAC (or other standard) electrical power allows the unit to be easily installed without the need for a licensed electrician or other skilled labor efforts. Communication capabilities allow the system to be operated using suitable local or remotely located user interfaces (e.g., smart phone apps, IoT devices, smart home monitoring systems, security systems, etc.).

While the various embodiments have contemplated the environment of a whole house fan (WHF) system that vents air from a residential space to a garage, other applications may be used as well, including but not limited to commercial structures, industrial applications, residential attics, etc.

By way of illustration, in an alternative embodiment the conditioned space 102 in FIG. 1 can represent an interior of a residential structure as before, but the unconditioned space 104 can be an attic or other portion of the residential structure. The damper assembly 122 can be in an interior vertical wall or horizontal ceiling that separates the respective spaces, and the exhaust assembly 124 can be configured to extend through a vertical exterior wall, a roof, etc.

In another example, the conditioned space can be a conditioned portion or zone of a commercial property, such as a set of offices or other type of work area, and the unconditioned space can be an unconditioned portion or zone of the commercial property such as a warehouse, loading dock, machine shop area, etc.

While the illustrated embodiments utilize a single damper assembly and a single exhaust assembly, further embodiments contemplate multiple sets of either or both. The windows 106 in FIG. 1 can be provided with dampers to be transitioned to an open position responsive to the opening of the damper assembly 122. Finally, while it is contemplated that the system is designed to be unidirectional, there may be applications where it is desirable to allow the airflow to reverse under some circumstances, so a bi-directional option for the exhaust assembly could be implemented as well.

Various changes and improvements will readily occur to the skilled artisan in view of the present disclosure, and such are encompassed by the spirit and scope of the following claims.

What is claimed is:

1. A ventilation system, comprising:

a damper assembly configured to extend through a first substrate separating a conditioned space and an unconditioned space in a building structure, the damper assembly comprising an interior door moveable between a normally closed position and an open position;

an exhaust assembly configured to extend through a second substrate separating the unconditioned space and an exterior of the building structure, the exhaust assembly comprising an electric motor configured to rotate an impeller; and a control circuit configured to activate the exhaust assembly to generate an initial flow of exhaust air from the unconditioned space to the exterior of the building structure while the interior door of the damper assembly is in the normally closed position, and to subsequently transition the interior door of the damper assembly to the open position responsive to a measured environmental parameter associated with the unconditioned space to establish a combined flow of exhaust air from the conditioned space, through the damper assembly, through the unconditioned space, and through the exhaust assembly to the exterior of the building structure, the measured environmental parameter comprising a differential pressure between a first interior pressure within the unconditioned space and a second interior pressure within the conditioned space.

2. The ventilation system of claim 1, wherein the control circuit comprises a first pressure sensor which senses a first pressure within the unconditioned space and a second pressure sensor which senses a different, second pressure within the conditioned space, and wherein the control circuit opens the damper assembly responsive to a determination that the first pressure within the unconditioned space is lower than the second pressure within the conditioned space.

3. The ventilation system of claim 1, wherein the conditioned space comprises an interior inhabited portion of a residential structure and the unconditioned space comprises a selected one of an attached garage or an attic of the residential structure.

4. The ventilation system of claim 1, wherein the exhaust assembly further comprises an exterior door moveable between a normally closed position and an open position, and wherein the control circuit further operates to transition the exterior door of the exhaust assembly to the open position prior to activation of the impeller.

5. The ventilation system of claim 1, wherein the damper assembly comprises a biasing mechanism that applies a closed biasing force to nominally retain the interior door in the normally closed position, the damper assembly further comprising an actuator which applies an opening biasing force to move the door to the open position responsive to a control signal from the control circuit.

6. The ventilation system of claim 1, wherein the damper assembly comprises a rectilinearly extending frame having a central passageway adapted to accommodate airflow therethrough, the central passageway sealingly covered by the interior door in the normally closed position.

7. The ventilation system of claim 6, wherein the frame is sized to span an interior space between two or more parallel support joists in the interior substrate, and to be attached to the two or more parallel support joints during installation.

8. The ventilation system of claim 7, wherein the frame has an overall width of nominally 32 inches and further has a central opening to accommodate, span and be attached to three adjacent support joists arranged on nominally 16 inch centers.

9. The ventilation system of claim 1, wherein the control circuit comprises a first control circuit module disposed within the damper assembly and a second control circuit module within the exhaust assembly, the first and second control circuits communicating via an intervening wired or wireless communication path.

10. The ventilation system of claim 1, wherein the interior door of the damper assembly comprises a planar layer of fire retardant barrier material conforming to local construction code requirements and a sealing gasket that establishes a fluidic seal between the planar layer of fire retardant barrier material and the first substrate when the interior door is positioned in the normally closed position against the first substrate.

11. The ventilation system of claim 1, wherein the damper assembly, the exhaust assembly and the control circuit are powered using at least one low voltage direct current (DC) power supply.

12. The ventilation system of claim 1, wherein the damper assembly further comprises a fusible mechanical link that causes the interior door to fail shut in sealing relation to the first substrate responsive to an anomalous event.

13. The ventilation system of claim 1, wherein the impeller provides a nominal flow rate of at least 3,000 cubic feet per minute (cfm) during normal operation.

14. The ventilation system of claim 1, wherein the control circuit comprises an exhaust assembly control circuit and a damper assembly control circuit, the exhaust assembly control circuit configured to, responsive to an input impeller activation signal, initiate activation of the motor to initiate rotation of the impeller and forward a communication signal to the damper assembly control circuit, and wherein the damper assembly control circuit is configured to activate an actuator to transition the interior door to the open position responsive to the communication signal, the communication signal forwarded after a determination is made, by the control signal, that a differential pressure exceeding a predetermined threshold exists between the conditioned space and the unconditioned space.

15. A method for ventilating a building structure, comprising:

activating an exhaust assembly that extends through an exterior substrate of a building structure to actively direct, via an impeller, an initial flow of exhaust air from an unconditioned space of the building structure to an exterior environment, the unconditioned space separated from a conditioned space of the building structure via an interior substrate through which a damper assembly extends having a moveable door in a closed position;

monitoring, via a pressure sensor, a differential pressure between the unconditioned space and the conditioned space; and subsequently transitioning, via a control signal from a control circuit coupled to the environmental sensor, the moveable door of the damper assembly from the closed position to an open position responsive to the differential pressure reaching a predetermined threshold to generate a combined flow of exhaust air from the conditioned space, through the damper assembly, through the unconditioned space, and through the exhaust assembly to the exterior of the building structure.

16. The method of claim 15, further comprising temporarily transitioning the moveable door from the open position back to the closed position during continued operation of the exhaust assembly responsive to a detected localized increase in pressure within the unconditioned space.

17. The method of claim 15, further comprising activating the exhaust assembly responsive to an input from a network accessible user device of a user, the network accessible user device further communicating the monitored environmental parameter to the user.

18. Apparatus comprising:

a damper assembly configured to be coupled to an opening extending through a first substrate separating a conditioned space and an unconditioned space in a building structure, the damper assembly comprising an interior door moveable between a closed position and an open position, wherein in the closed position the interior door seals off the conditioned space from the unconditioned space and in the open position fluidic communication is established through the aperture in the first substrate between the conditioned space and the unconditioned space;

an exhaust assembly configured to extend through a second substrate separating the unconditioned space and an exterior of the building structure, the exhaust assembly comprising an electric motor configured to rotate an impeller;

a pressure sensor configured to sense a first pressure of the unconditioned space and a second pressure of the conditioned space; and a controller configured to activate the exhaust assembly to generate an initial flow of exhaust air from the unconditioned space to the exterior of the building structure while the interior door of the damper assembly is in the closed position, and to subsequently transition the interior door of the damper assembly to the open position responsive to a determination that the second pressure exceeds the first pressure by a predetermined pressure interval.

19. The apparatus of claim 18, wherein the pressure sensor is further configured to subsequently detect an increase in pressure in the unconditioned space and the control circuit is configured to, in response, transition the interior door of the damper assembly to the closed position.

20. The apparatus of claim 18, wherein the interior door of the damper assembly comprises a planar layer of fire retardant barrier material conforming to local construction code requirements and a sealing gasket that establishes a fluidic seal between the planar layer of fire retardant barrier material and the first substrate when the interior door is positioned in the closed position.

* * * * *